US006223552B1

(12) United States Patent
Zimmerbauer et al.

(10) Patent No.: US 6,223,552 B1
(45) Date of Patent: May 1, 2001

(54) DEVICE FOR THE CONTROLLED COOLING OF HOT-BRIQUETTED DIRECTLY REDUCED IRON SPONGE

(75) Inventors: Karl-Heinz Zimmerbauer, Hargelsberg; Helmut Schober, Neuzeug; Franz Hoertnagl, Oberperfuss; Wolfgang Tscherne, Marchtrenk, all of (AT)

(73) Assignee: Voest-Alpine Industrieanlagenbau GmbH, Linz (AT)

( * ) Notice: Subject to any disclaimer, the term of this patent is extended or adjusted under 35 U.S.C. 154(b) by 0 days.

(21) Appl. No.: 09/355,176

(22) PCT Filed: Jan. 27, 1998

(86) PCT No.: PCT/US98/00014

§ 371 Date: Aug. 4, 1999

§ 102(e) Date: Aug. 4, 1999

(87) PCT Pub. No.: WO98/33943

PCT Pub. Date: Aug. 6, 1998

(30) Foreign Application Priority Data

Jan. 29, 1997 (AT) ..... A 125/97

(51) Int. Cl.[7] ..... F17C 17/02

(52) U.S. Cl. ..... 62/373; 62/63; 198/822; 198/841

(58) Field of Search ..... 62/63, 373; 198/822, 198/841

(56) References Cited

U.S. PATENT DOCUMENTS

| | | | | |
|---|---|---|---|---|
| 1,996,781 | * | 4/1935 | Winton et al. | 62/63 |
| 4,087,265 | * | 5/1978 | Benson | 62/63 |
| 4,582,193 | | 4/1986 | Larsson . | |
| 5,115,908 | * | 5/1992 | Williams | 198/841 |

FOREIGN PATENT DOCUMENTS

| | | |
|---|---|---|
| 621746 | 2/1981 | (CH) . |
| 964127 | 5/1957 | (DE) . |
| 1194319 | 6/1965 | (DE) . |
| 0002137 | 5/1979 | (EP) . |
| 0105954 | 4/1984 | (EP) . |
| 1364451 | 10/1964 | (FR) . |
| 2069442 | 8/1981 | (GB) . |
| 2108459 | 5/1983 | (GB) . |

* cited by examiner

*Primary Examiner*—Ronald Capossela
(74) *Attorney, Agent, or Firm*—Ostrolenk, Faber, Gerb & Soffen, LLP

(57) ABSTRACT

In an arrangement for the controlled cooling of hot-briquetted direct-reduced sponge iron in the form of an apron conveyer consisting of individual plates and located in a tank, the individual plate is designed as conveyor trough (4), wherein at least one sliding plate each (5 and 6) is located on the two opposed longitudinal outsides and the conveyor troughs (4) are movable supported by means of sliding plates (5 and 6) on slideways (7) and connected by means of at least one chain (9). The invention allows to separate the drive and the bearing as the conveyor troughs (4) are supported by means of sliding plates (5 and 6) and the drive acts directly on the conveyor trough (4) by means of at least one chain (9). As the translation elements are designed as sliding plates (5, 6) and slideways (7), the surface pressure is reduced to less than one hundredth compared to wheels running on rails and the wear of the translation elements is thus reduced.

17 Claims, 2 Drawing Sheets

DEVICE FOR THE CONTROLLED COOLING OF HOT-BRIQUETTED DIRECTLY REDUCED IRON SPONGE

The invention relates to an arrangement for the controlled cooling of hot-briquetted direct-reduced sponge iron in the form of an apron conveyor located in a tank.

An arrangement for cooling is known from the German patent specification DE 29 28 501 C2. This arrangement is comprised of a quench tank and a conveyor placed therein in inclined position for transporting connected briquettes.

In the different processes for the direct reduction of iron, solid oxidic input material is reduced to iron by means of reduction gases. The pellets or lump ores formed thereby can only be stored under special protective conditions as due to the microporosity of the products an exothermal reaction with atmospheric oxygen may occur. Therefore, a hot-briquetting plant has been connected downstream of several processes in order to compact the reduced material and, thus, to reduce the risk of reoxidation due to the surface which is reduced thereby.

The briquettes formed during hot briquetting have a temperature of approx. 750° C. and are cooled to approx. 50° C. in order to prevent self-ignition. However, the energy stored in the cooled briquettes must still suffice to dry them up.

Cooling is performed in a quench tank, i.e. a tank filled with water, in which wire mesh belt conveyors or apron conveyors are located onto which the hot briquettes drop. The apron conveyors consist of perforated plates connected to one another, to which wheels running on rails are mounted by means of pins. The plates are connected to one another by fishplate bush links. The conveyors are driven by a conveyor chain connected with the wheel axles.

The fines accompanying the briquettes get onto the bottom of the tank as well as onto the rails through the holes in the plates. Combined with aggressive substances in water, with the high surface pressure acting on the supporting surfaces of the wheels at the rails and with the radial stresses occurring, primarily the wheels and pins are highly worn. As the wheels run dry in front of the point of briquette discharge, the aforementioned conditions are aggravated by the alternation of wet and dry condition.

The object of the invention is to develop a cooling system to reduce the wear of the conveyor elements and thus to increase the availability of the cooling system due to the lower maintenance expenditure. The design of the plates and of the drive is to be modified so that less fines penetrate into highly stressed areas.

The invention is characterized in that the individual plate is designed as conveyor trough, at least one sliding plate each being located on the two opposed longitudinal outsides and the conveyor troughs being movably supported on rails by means of the sliding plates and connected with at least one chain.

A novelty of this invention is that the drive and the bearing can be separated as the conveyor troughs are supported by means of sliding plates and the drive acts directly on the conveyor trough by means of at least one chain.

As the translation elements are designed as sliding plates and rails, the surface pressure is reduced to less than one hundredth compared to wheels running on rails. As a result, the wear of the translation elements is reduced. The sliding plates cover the slideways partly from the material flow so that less fines get directly onto the slideways and wear is further reduced.

Another feature of the invention is that one mounting plate each is located on the two opposed longitudinal outsides of the conveyor trough, to which mounting plate one sliding plate each is fixed on its upper and lower sides. This type of mounting of the sliding plates on the conveyor trough enables the sliding plates to be easily exchanged if they are worn.

Another feature of the invention is that, if two sliding plates are placed on each longitudinal outside and at each conveyor trough, the upper sliding plate—seen in the direction of conveying—is thinner than the lower sliding plate. This feature takes into account that the lower sliding plate is subject to higher wear due to the loading of the conveyor trough and the direct action of fine material and the upper and lower sliding plates can thus be simultaneously exchanged, which results in increased plant availability.

Another feature of the invention is that the individual conveyor trough is driven by means of at least one chain, preferably a round steel chain, a detachable connection being established between the conveyor trough and the chain. Driving by means of chains has the advantage that guidance of the conveyor troughs is ensured by prestressing the chain. The detachable connection between the conveyor trough and the chains facilitates plant maintenance.

The invention is further characterized in that the individual conveyor trough is driven by means of at least one chain, preferably a round steel chain, which is provided with plug-in pushers detachably connected with fishplates located on the bottom side of each conveyor trough. The fishplate arrangement on the bottom side of the conveyor trough has the advantage that the latter protects the chains engaging there from the direct action of sponge iron briquettes or fine material. Moreover, the use of round steel chains is advantageous as these are self-cleaning.

Another feature of the invention is that the conveyor troughs are made of brace plates, which reduces the probability of deformation of the conveyor troughs by impact on the side stop.

The feature of one side stop being placed on both sides of the conveyor troughs serves for emergency guidance of the conveyor troughs in case of a sideward motion resulting from loading the conveyor trough, on the one hand, and for protecting the tank, on the other hand, because the side stop prevents the conveyor trough from damaging the tank wall.

An essential feature of the invention is that the horizontal distance between the upper sliding plate and the side stop amounts to maximally half the average diameter of the sponge iron briquettes. This is to prevent the sponge iron briquettes from dropping between the sliding plate and side stop, from getting jammed there and locking the conveyor troughs, or from causing increased wear.

The last feature of the invention is that in the area of the slideways that is located above water level a spraying device is placed, which ensures uniform sliding conditions for the sliding plates and rinses deposits of fine material from the slideways into the tank.

The invention is to be explained by an embodiment. The enclosed FIGS. 1 to 3 display a schematic representation of this embodiment.

Figure 1:
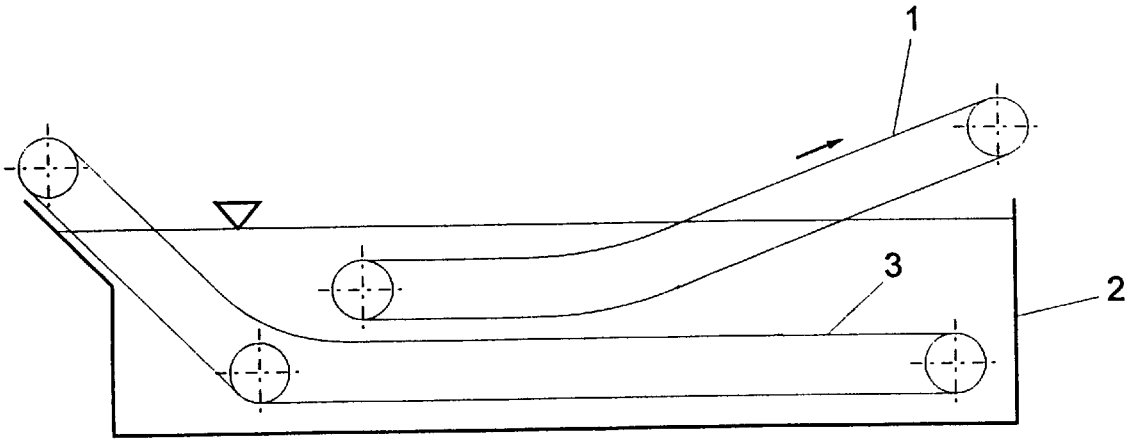
FIG. 1 shows a vertical section through the tank in which the apron conveyor is located.

FIG. 1 shows apron conveyor 1 located in tank 2 filled with water, arranged together with drag conveyor 3, which is not described in detail here. Hot sponge iron is charged onto apron conveyor 1 in the area of the left deflection of apron conveyor 1 where the latter is located below water level, conveyed further to the right according to the arrow while being cooled in water and discharged at the right end of tank 2. Drag conveyor 3 only serves to discharge the fine material settled on the bottom of tank 2.

Figure 2:
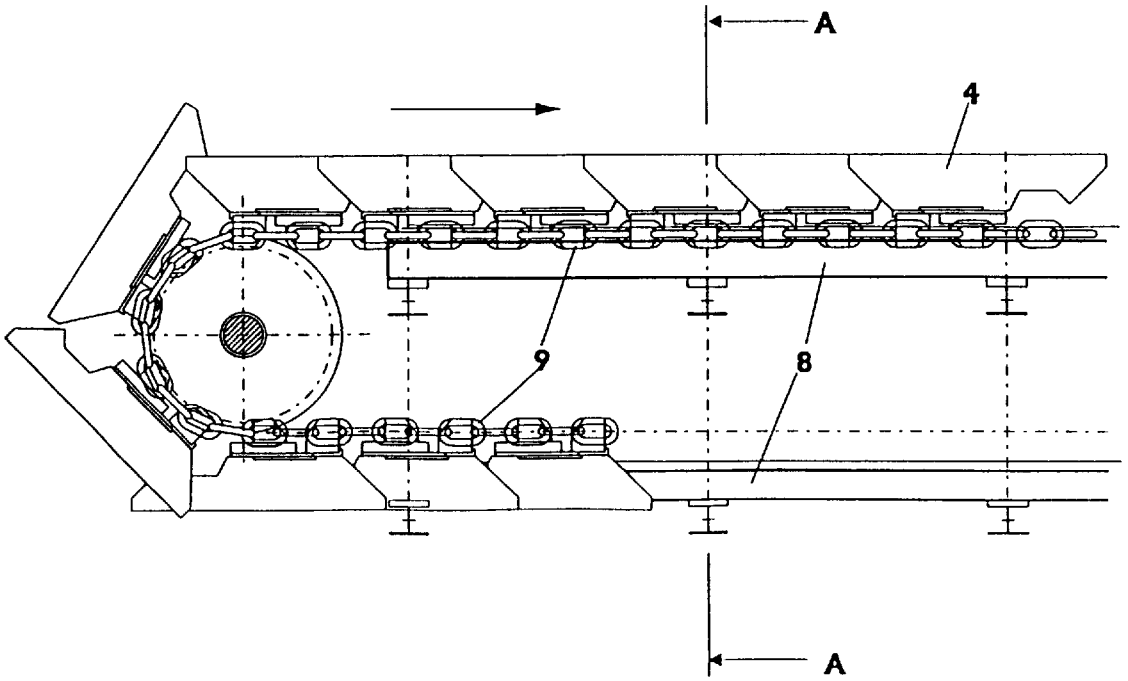
FIG. 2 shows a detail of the apron conveyor according to FIG. 1.

FIG. 2 shows the left part of apron conveyor 1 according to FIG. 1 with the deflection device for conveyor troughs 4. The individual plates of apron conveyor 1 are designed as conveyor troughs 4. The latter are preferably made of folded steel plate, in particular of so-called brace plates, which are resistant to radial stresses. The moving direction of the conveyor troughs is marked by the arrow. Conveyor troughs 4 are fixed to chains 9 by which driving is performed. Furthermore, rolled section beams 8 are shown on which rails 7 are mounted.

Figure 3:
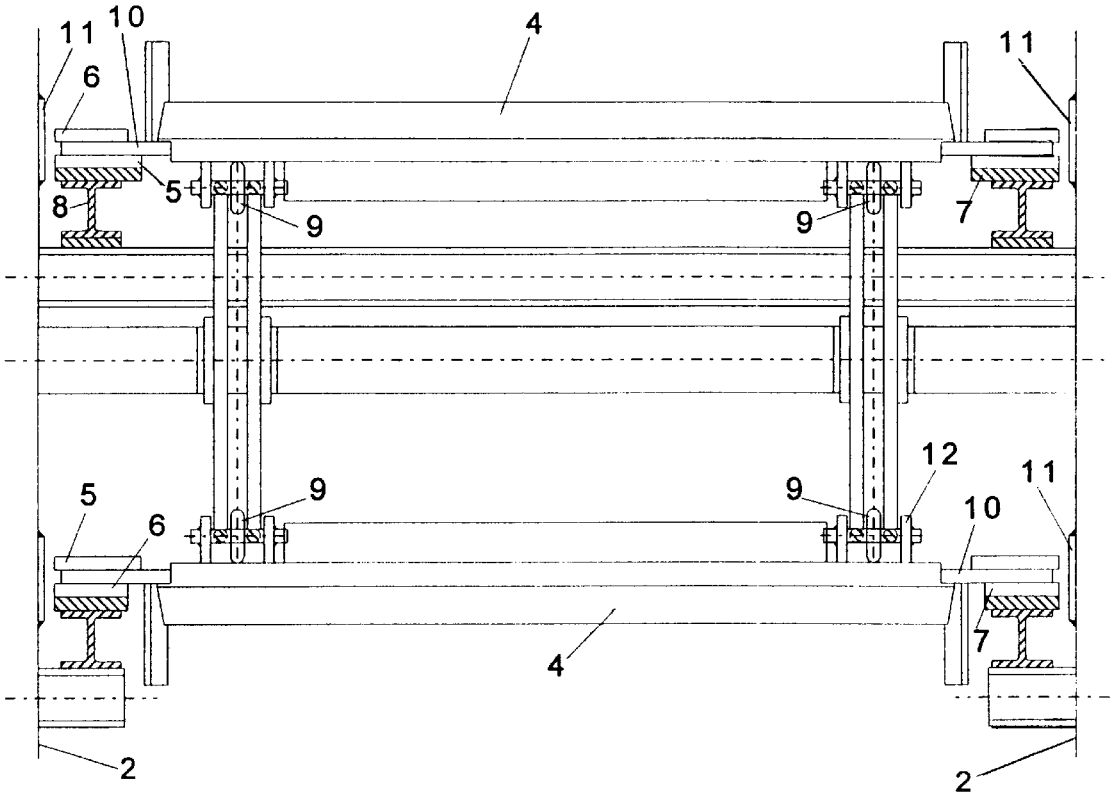
FIG. 3 shows a section through A—A in FIG. 2.

FIG. 3 shows a section through A—A in FIG. 2. Conveyor trough 4 shown on the top moves in conveying direction, and lower conveyor trough 4 in opposite direction. The side walls of conveyor troughs 4 are higher than the front and rear walls. On the two opposed longitudinal outsides of conveyor troughs 4 forming the two outsides of apron conveyor 1 two sliding plates 5, 6 each made of wear steel are mounted. The two sliding plates 5, 6 of one side are arranged one above the other so that lower sliding plates 5 are in operation while conveyor trough 4 is moving in conveying direction and sliding plates 6, which are located on top in conveying direction, are in operation while conveyor trough 4 is moving in the opposite direction. One sliding plate 5, 6 each is fixed to mounting plate 10 which is permanently connected to conveyor trough 4.

Conveyor troughs 4 are moved by means of sliding plates 5, 6 on wear-resistant slideways 7 which are mounted on rolled section beams 8. Slideways 7 serve as a sliding basis for sliding plates 5, 6 and, together with rolled section beams 8, absorb the longitudinal forces and radial stresses resulting from belt movement.

Conveyor troughs 4 are driven through chains 9 provided with wear-resistant plug-in pushers. On the bottom side of each trough conveyor 4 fishplates 12 are arranged in a way that the pushers of chain 9 engage with the latter. The plug-in pushers are secured with clamping sleeves. The connection between chain 9 and conveyor trough 4 is detachable. The tensile forces are transmitted to conveyor troughs 4 through chains 9, conveyor troughs 4 not being connected to one another. Conveyor troughs 4 thus do not have to absorb any tensile forces of the chains. The prestress of chain 9 supports guidance of conveyor troughs 4.

Chains 9 are preferably designed as round steel chains. They are guided between slideways 8 beneath conveyor troughs 4 and largely protected by the latter from being contaminated.

Side stop 11 is placed on both sides of conveyor troughs 4. Due to the sponge iron load, conveyor troughs 4 may receive a short-time pulse which is largely directed sidewards, which is caught by the side stop so that the wall of tank 2 is also protected.

For those parts of rails 7 which are located above water level, a spraying device is provided to ensure that rails 7 have the same sliding conditions at all points.

What is claimed is:

1. An apron conveyor, consisting of individual plates having a trough section comprising conveyor troughs (4) and an extension section with the extension section positioned between upper and lower sliding plates (5, 6), the conveyor troughs (4) being movably supported on rails (7) by means of sliding plates (5 and 6) and connected by means of at least one chain (9).

2. An apron conveyor according to claim 1, wherein on the two opposed longitudinal outsides of the conveyor trough (4) one mounting plate (10) each is located to whose upper and lower sides one sliding plate each (5, 6) is mounted.

3. An apron conveyor according to claim 1, wherein said sliding plates (5 and 6) are located on each longitudinal outside edge and at each conveyor trough (4), the upper sliding plate (6) is thinner than the lower sliding plate (5).

4. An apron conveyor as claimed in claim 1, wherein, the individual conveyor trough (4) is driven by means of at least one chain (9), preferably a round steel chain, and that a detachable connection is provided between the conveyor trough (4) and the chain (9).

5. An apron conveyor as claimed in claim 1, wherein that the individual conveyor trough (4) is driven by means of at least one chain (9), preferably a round steel chain, provided with plug-in pushers, the latter being detachably connected with fishplates (12) located on the bottom side of each conveyor trough (4).

6. An apron conveyor as claimed in claim 1, wherein the conveyor troughs (4) are made of brace plates.

7. An apron conveyor as claimed in claim 1, wherein one side stop (11) each is located on both sides of the conveyor troughs (4).

8. An apron conveyor as claimed in claim 7, wherein the horizontal distance between the upper sliding plate (6) and the side stop (11) amounts to maximally half the average diameter of the sponge iron briquettes.

9. An arrangement for the controlled cooling of hot-briquetted direct-reduced sponge iron, comprising a quench tank for containing cooling water, and an apron conveyor located partially in said quench tank and partially outside said quench tank, said apron conveyor, consisting of individual plates having a trough section comprising conveyor troughs (4) and an extension section with the extension section positioned between upper and lower sliding plates (5, 6), the conveyor troughs (4) being movably supported on rails (7) by means of sliding plates (5 and 6) and connected by means of at least one chain (9).

10. Arrangement as claimed in claim 9, wherein a spraying device is located in the area of the slideways (7) that is located above water level.

11. An arrangement as claimed in claim 9, wherein on the two opposed longitudinal outsides of the conveyor trough (4) one mounted plate (10) each is located to whose upper and lower sides one sliding plate each (5, 6) is mounted.

12. An arrangement as claimed in claim 9, wherein if two sliding plates (5 and 6) are located on each longitudinal outside and at each conveyor trough (4), the upper sliding plate (6)—seen in conveying direction—is thinner than the lower sliding plate (5).

13. An arrangement as claimed in claim 9, wherein the individual conveyor trough (4) is driven by means of at least one chain (9), preferably a round steel chain, and that a detachable connection is provided between the conveyor trough (4) and the chain (9).

14. An arrangement as claimed in claim 9, wherein that the individual conveyor trough (4) is driven by means of at least one chain (9), preferably a round steel chain, provided with plug-in pushers, the latter being detachably connected with fishplates (12) located on the bottom side of each conveyor trough (4).

15. An arrangement as claimed in claim 9, wherein the conveyor troughs (4) are made of brace plates.

16. An arrangement as claimed in claim 9, wherein one side stop (11) each is located on both sides of the conveyor troughs (4).

17. An arrangement as claimed in claim 16, wherein the horizontal distance between the upper sliding plate (6) and the side stop (11) amounts to maximally half the average diameter of the sponge iron briquettes.

* * * * *